United States Patent [19]

Ballantyne et al.

[11] Patent Number: 4,608,850

[45] Date of Patent: Sep. 2, 1986

[54] ALLIGATOR DEFECT ELIMINATION

[75] Inventors: John A. Ballantyne, Bettendorf, Iowa; William L. Otto, Jr., Allegheny Township, Westmoreland County, Pa.

[73] Assignee: Aluminum Company of America, Pittsburgh, Pa.

[21] Appl. No.: 775,344

[22] Filed: Sep. 12, 1985

[51] Int. Cl.[4] ..... B21B 31/20

[52] U.S. Cl. ..... 72/240; 72/248; 72/366

[58] Field of Search ..... 72/240, 248, 365, 366

[56] References Cited

U.S. PATENT DOCUMENTS 3,431,762 3/1969 O'Brien ..... 72/248

FOREIGN PATENT DOCUMENTS 158801 12/1980 Japan ..... 72/240
14004 2/1981 Japan ..... 72/366
825211 4/1981 U.S.S.R. ..... 72/240

*Primary Examiner*—Francis S. Husar
*Assistant Examiner*—Jorji M. Griffin
*Attorney, Agent, or Firm*—Elroy Strickland

[57] ABSTRACT

A method of operating a rolling mill in a manner that avoids the occurrence of alligatoring in a slab of metal as it is reduced in thickness in the mill. The slab is subject to a schedule of repeated passes through the mill to effect a predetermined amount of reduction in thickness of the slab in each pass. The method comprises the steps of analyzing the pass schedule of such a slab, and noting any pass in the schedule that has a combination of entry gauge and reduction draft that may subject the slab to alligatoring. An untapered nose of the slab is next presented to the bite of the mill, and if the combination of entry gauge and reduction draft is one that is not subject to alligatoring, the slab is passed through the mill to reduce its thickness as scheduled. However, if the combination of entry gauge and reduction draft is one that causes or tends to cause alligatoring in the slab, the method changes the size of the working gap of the mill by an amount that changes the combination of entry gauge and reduction draft to one that does not subject the slab to alligatoring. The nose of the slab is then directed to the bite of the mill having the changed working gap, and, once the nose of the slab has entered the bite of the mill, the working gap thereof is returned to the size that will effect the schedule reduction and thickness of the slab.

1 Claim, 3 Drawing Figures

ALLIGATOR DEFECT ELIMINATION

BACKGROUND OF THE INVENTION

The present invention relates generally to the thickness reduction of metal slabs, and particularly to a method that reduces the thickness in a manner that avoids alligatoring in the ends of the slabs.

Two procedures for preventing alligatoring in slabs are discussed in commonly assigned pending U.S. application Ser. Nos. 632,406 (now U.S. Pat. No. 4,584,862) and 658,157, filed respectively on July 19, 1984 and Oct. 5, 1984. The disclosure of the present application provides yet a third alternative procedure for eliminating or at least substantially limiting the occurrence of alligatoring. A discussion of the causes of alligatoring is contained in both applications, the subject matter of both applications being incorporated herein by reference.

BRIEF SUMMARY OF THE INVENTION

The present invention includes the use of the model disclosed in the above two applications, which model employs certain combinations of thickness draft or reduction and the entry thickness or gauge of the slab to avoid alligatoring. In the present invention, this model is employed by first noting any pass in a schedule of passes for reducing the thickness of an ingot to slab that has a combination of entry gauge and reduction draft that may cause alligatoring. Before the pass is started and the ingot presented to the bite of the mill, the size of the working gap of the mill is changed to an amount that changes the combination of entry thickness and draft such that the slab will not be subject to alligatoring. The nose of the slab is then directed into the mill, and once the nose of the slab has entered into the mill, the working gap of the mill is returned to the size that will effect the schedule reduction in thickness. In this manner, alligatoring is avoided since alligatoring occurs at and propagates from the ends of the noses and tails of slabs.

THE DRAWINGS

The invention, along with its advantages and objectives, will best be understood from consideration of the following detailed description and the accompanying drawings, in which.

PREFERRED EMBODIMENT

Figure 1:
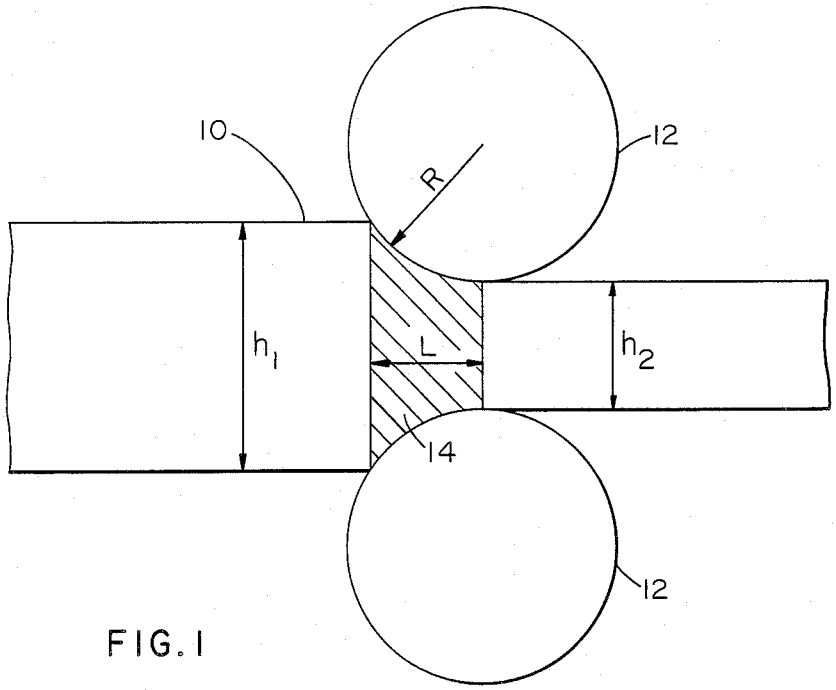
FIG. 1 is a partial elevation view of the work rolls and work zone of a rolling mill for breaking down the thickness of an ingot.

Referring now to the drawings, and particularly FIG. 1 thereof, two work rolls 12 of a rolling mill (not otherwise shown) are depicted in elevation and a slab of metal 10 is shown in partial elevation in the process of being directed through the work zone 14 of the work rolls. The work zone has a length L that extends from the location at which slab 10 engages the work rolls as it enters zone 14 (from the left in FIG. 1) to the location at which the slab ceases to contact the rolls at the right thereof.

The average thickness of the slab in work zone 14 can be defined by the formula:

$$h \approx (H_1 + h_2)/2 \tag{1}$$

where $h_1$ is the thickness of the slab entering the work zone, and $h_2$ is the thickness of the slab leaving the work zone.

Figure 2:
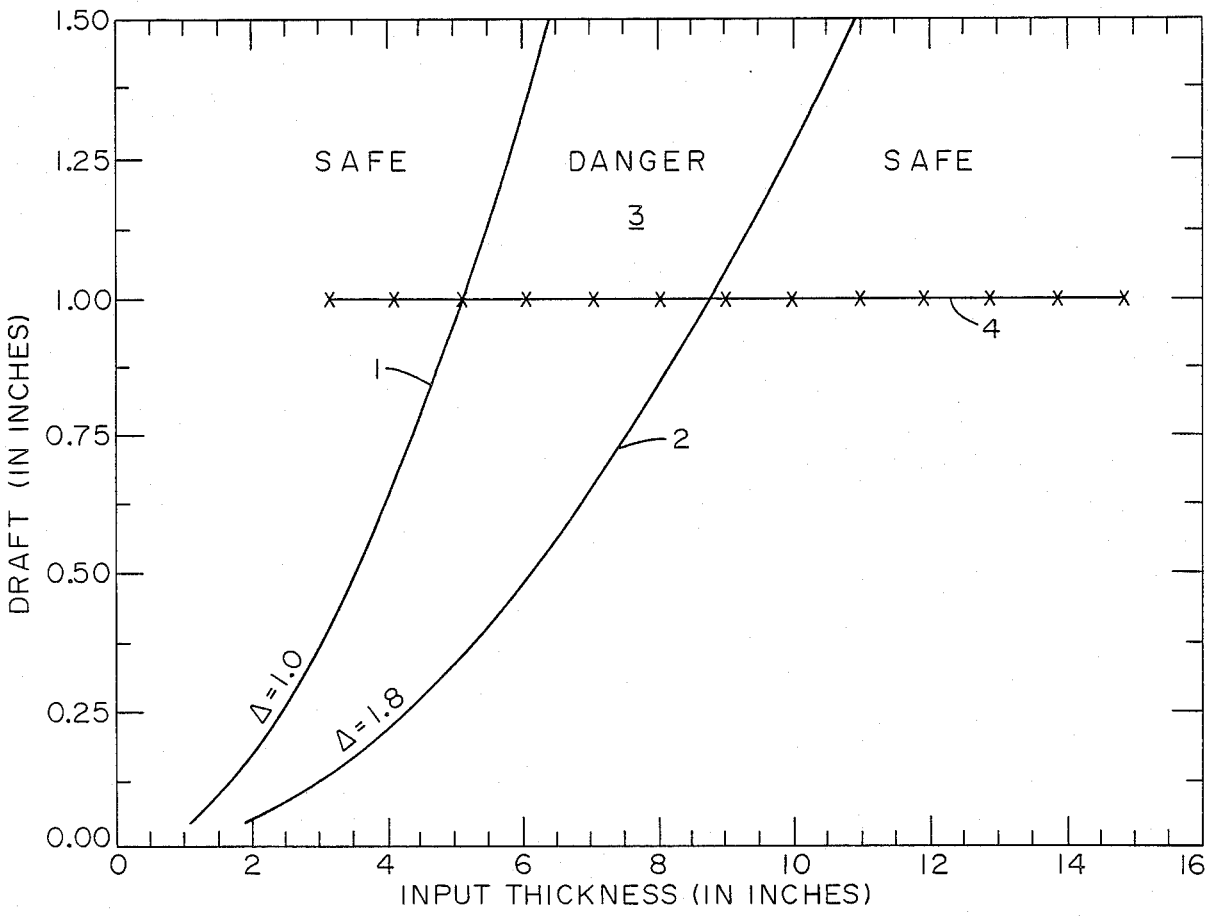
FIG. 2 are plots of experimental data that establish rolling criteria for avoiding alligator fractures.

FIG. 2 of the drawings is a graph showing two solid line curves 1 and 2 that represent the results of experimental data developed from rolling slabs in a breakdown mill. The abscissa of the graph indicates input thicknesses (in inches) of a slab to be reduced in thickness, while the ordinate of the graph represents drafts or reductions in thickness (in inches) taken by the mill when a slab is directed therethrough. Hence, the two curves define combinations of slab entry thickness and thickness reduction, and a zone 3 of input thickness versus draft, in which alligator defects tend to occur. Either side of zone 3 are the "safe" zones where alligators do not occur.

The two curves of FIG. 2 are developed from the equation:

$$h_1 = \Delta\sqrt{R(h_1 - h_2)} + (h_1 - h_2)/2 \tag{2}$$

where $\Delta$ is the ratio of the average thickness of a slab in a work zone (14) of a rolling mill to the length of the work zone, $h_1$ and $h_2$ are respectively the entry and exit thicknesses of the slab, as indicated in FIG. 1, $h_1 - h_2$ is the thickness reduction or draft effected in the work zone, and R is the radius of the work rolls of the mill.

$\Delta$, i.e., the delta value, being a ratio is dimensionless.

The above formula (2) is derived from the formula:

$$\Delta \approx \sqrt{h_o/4Rr}\,[2 - r] \tag{3}$$

disclosed on page 88 of the textbook "Deformation Processing" by Walter A. Backofen, published in 1972 by Addison-Wesley Publishing Company. This latter formula defines the basic feature of the channel between the work rolls of a mill. The definition is in terms of the mean thickness to length ratio of the plastic work zone or area that fills the channel. The term "$h_o$" is that of "$h_1$" (entry thickness) in equation (2), and "r" is the reduction $$(h_1 - h_2)/h_1 \tag{4}$$

A straight line 4 is shown on the graph of FIG. 2 to denote a pass schedule in which constant, one-inch (on the ordinate of graph) reductions in thickness of a slab or ingot are taken in "breaking down" an ingot. On line 4 are a series of X's, the X's representing input thickness and the amount of reduction taken in each pass. Hence, in starting with a 15-inch slab, a one-inch reduction pass reduces the thickness of the slab to 14 inches.

It will be noted that curve 1 in FIG. 2 describes a boundary on the left that represents $\Delta = 1.0$ (of equation 2), while curve 2, on the right, represents $\Delta = 1.8$. Between these two curves is a zone 3 in which alligatoring fractures tend to occur. On the left-hand side of curve 1, and on the right-hand side of curve 2, the reductions taken on an ingot or slab are in a "safe" zone with regard to the formation of alligator fractures. For example, if one-inch reductions taken on ingots that are greater than approximately 8.75 inches in thickness, as represented on the right-hand side of curve 2, the ends of the ingot will not experience the alligator phenomenon. The ends of such an ingot will, however, form such fractures when one-inch reductions are taken on ingots of 8.75 inches in thickness, down to about 5.10 inches in thickness; on the graph of FIG. 2 the alligatoring tendency begins adjacent the seventh pass and continues for about three one-inch passes (X's) in zone 3. When the one-inch reductions move to a point beyond curve 1 on the left, alligatoring ceases or tends not to occur.

Figure 3:
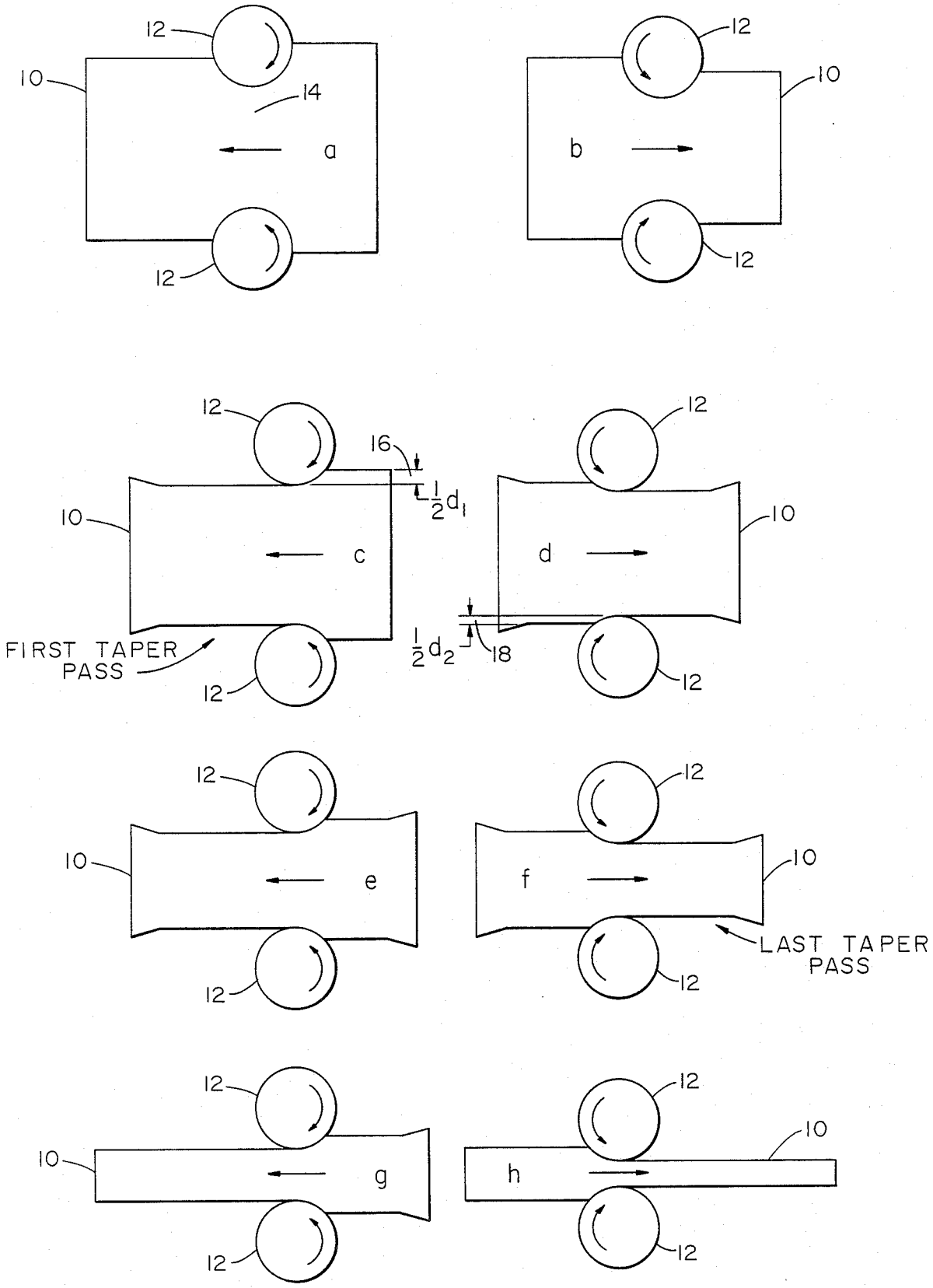
FIGS. 3*a* through 3*h* show the procedure of the subject invention that avoids alligatoring.

FIG. 3 of the drawings shows somewhat diagrammatically the procedure of the present invention. A person or computer operating a reversing mill for breaking down ingot and slabs first notes the pass schedule, as depicted in FIG. 2, of an ingot 10 to be reduced in gauge or thickness in the mill. In the case of the computer, the computer's storage facility is loaded with information of the pass schedule, i.e., with the original thickness value of the ingot to be broken down, the number of passes through the mill at chosen drafts required to reach final breakdown thickness, and the final thickness value itself. If any combination of entry gauge and reduction draft falls in the safe zones of FIG. 2, the reduction is taken as scheduled.

FIGS. 3*a* and 3*b* show two such scheduled passes in a reversing mill.

However, if a combination of entry thickness and reduction draft arises that may cause or tend to cause alligator fracturing of the ingot or slab, i.e., if the combination falls in the danger zone 3 of FIG. 2, the workman or computer orders the opening or closing of the gap between work rolls 12 such that the combination of entry thickness and reduction draft is now outside the danger zone. The untapered end or nose of the slab thus enters the widened or narrowed bite of the mill without danger of alligator formation. As soon as the nose of the slab had entered the work zone, however, the working gap is returned to its scheduled setting such that the scheduled reduction in thickness begins. This leaves a relatively short taper of material at the end of the slab, which as shown in FIG. 3*c*, for example is enlarged, if the change in the working gap was one of increasing the gap. If the change was one of closing (decreasing) the gap, the short taper would occur in the opposite direction.

In FIG. 3*c*, the pass is completed, with the end opposite the tapered end passing through the working gap without changing the size of the roll gap. The tail end is thereby rolled out flat (see draft 16 in FIG. 3*c*), as alligators generally do not form as a slab exits the roll gap. The next pass will avoid alligatoring by tapering on the initial bite of that pass. Alligatoring is not a problem on tailout, as the rotation of the work rolls of a mill is in an inward direction, as opposed to the outward direction of roll rotation after the nose of an ingot enters the bite of the rolls.

In FIG. 3*d* of the drawings, the combination of entry thickness and reduction draft lies again in the danger area such that the working gap of the mill is changed to avoid alligatoring. Hence, a short taper at the forward end of the slab will occur as a result of changing of the gap before the draft assumes its scheduled reduction, see 18 in FIG. 3*d*.

This process continues until it is no longer necessary to change the working gap. In FIG. 3, the gap changing process occurs through FIG. 3*f*. When the thickness of the slab reaches a point where alligatoring is not a problem when the next scheduled pass is taken, the working gap is not changed and the slab is directed into the bite of the mill and passed therethrough. This is the case in FIGS. 3*g* and 3*h* of the drawings. In FIG. 3*g*, the last tapers are removed by the scheduled pass, such that in the pass of FIG. 3*h*, no tapers remain.

Specific dimension examples are provided in FIG. 2. When the thickness of slab 10 reaches four inches, for example (see abscissa of the graph of FIG. 2), and the scheduled draft is at least one inch (see ordinate of the graph), the combination of slab thickness and scheduled draft lies to the left of curve 1 of the graph and thus lies in a "safe" area. The slab is therefore directed through the mill without changing the spacing of working gap 14. Similarly, when the thickness of the slab reaches three inches, any scheduled reduction approaching one-half inch can be made without a problem.

While the invention has been described in terms of preferred embodiments, the claims appended hereto are intended to encompass all embodiments which fall within the spirit of the invention.

What is claimed is:

1. A method of operating a rolling mill in a manner that avoids the occurrence of alligatoring in a slab of metal as it is reduced in thickness in the mill, the slab being subject to a schedule of repeated passes through the mill to effect a predetermined amount of reduction in the thickness of the slab in each pass, the method comprising the steps of:

analyzing the pass schedule of a slab to be reduced in thickness, noting any pass in the schedule that has a combination of entry gauge and reduction draft that may subject the slab to alligatoring, presenting a nose of the slab to the bite of the mill, changing the size of the working gap of the mill by an amount that changes the combination of entry gauge and reduction draft to one that does not subject the slab to alligatoring, directing the nose of the slab into the bite of the mill having the changed working gap, once the nose of the slab has entered the bite of the mill, returning the working gap of the mill to the size that will effect the scheduled reduction in thickness of the slab, and completing the pass of the slab through the mill to effect the scheduled reduction in thickness of the slab.

* * * * *